US010326224B2

(12) United States Patent
Takahashi

(10) Patent No.: US 10,326,224 B2
(45) Date of Patent: Jun. 18, 2019

(54) PORTABLE PRINTER

(71) Applicant: SEIKO INSTRUMENTS INC., Chiba-shi, Chiba (JP)

(72) Inventor: Masanori Takahashi, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 15/703,076

(22) Filed: Sep. 13, 2017

(65) Prior Publication Data

US 2018/0097302 A1 Apr. 5, 2018

(30) Foreign Application Priority Data

Oct. 5, 2016 (JP) ..... 2016-197505

(51) Int. Cl.

| | |
|---|---|
| ***B41J 2/32*** | (2006.01) |
| ***H01R 12/71*** | (2011.01) |
| ***B41J 3/36*** | (2006.01) |
| ***B41J 29/02*** | (2006.01) |
| ***H01R 13/50*** | (2006.01) |
| ***H01R 13/516*** | (2006.01) |
| ***B41J 29/13*** | (2006.01) |
| ***H01R 13/46*** | (2006.01) |
| ***H01R 13/52*** | (2006.01) |
| ***H01R 13/56*** | (2006.01) |

(52) U.S. Cl.

CPC ..... *H01R 12/716* (2013.01); *B41J 2/32* (2013.01); *B41J 3/36* (2013.01); *B41J 29/02* (2013.01); *B41J 29/023* (2013.01); *B41J 29/13* (2013.01); *H01R 13/46* (2013.01); *H01R 13/50* (2013.01); *H01R 13/516* (2013.01); *H01R 13/5202* (2013.01); *H01R 13/567* (2013.01)

(58) Field of Classification Search

None

See application file for complete search history.

(56) References Cited

U.S. PATENT DOCUMENTS

| | | | | |
|---|---|---|---|---|
| 4,732,502 | A | 3/1988 | Yokoi | 400/693 |
| 2005/0124225 | A1* | 6/2005 | Wang | H01R 24/64 439/676 |

(Continued)

FOREIGN PATENT DOCUMENTS

| | | |
|---|---|---|
| JP | 2012045808 | 3/2012 |
| WO | 02009054 | 1/2002 |
| WO | 2017077859 | 5/2017 |

OTHER PUBLICATIONS

European Search Report dated Mar. 2, 2018 in Application No. EP 17 19 4588.

*Primary Examiner* — Erica S Lin

(74) *Attorney, Agent, or Firm* — Adams & Wilks

(57) ABSTRACT

A portable printer includes a casing accommodating a printer module and a control board accommodated in the casing and electrically connected to the printer module. A female-side connector is mounted on the control board and exposed to an outside of the casing through a connector opening formed in the casing. The female-side connector is configured to detachably mount a male-side connector. A connector cover made of an elastically deformable material is interposed between an inner peripheral surface of the connector opening and an outer peripheral surface of the female-side connector along an entire circumference of the female-side connector.

18 Claims, 6 Drawing Sheets

(56) References Cited

U.S. PATENT DOCUMENTS

| | | | | |
|---|---|---|---|---|
| 2005/0224569 | A1 | 10/2005 | Silverbrook et al. | 234/5 |
| 2006/0019513 | A1* | 1/2006 | Mizuno | H01R 13/56 439/76.1 |
| 2010/0044572 | A1* | 2/2010 | Nishino | A61B 6/00 250/370.08 |
| 2011/0165793 | A1* | 7/2011 | Zhou | H01R 13/5205 439/589 |
| 2012/0050448 | A1* | 3/2012 | Sakaino | B41J 3/36 347/222 |
| 2016/0036157 | A1 | 2/2016 | Endo et al. | |

* cited by examiner

PORTABLE PRINTER

BACKGROUND OF THE INVENTION

1. Field of the Invention

The present invention relates to a portable printer.

2. Description of the Related Art

There have been known portable printers configured to output (print) information, which is input to a host device (for example, personal digital assistant (PDA)), at visiting places or the like. The portable printer of this type includes a casing in which a printer module is accommodated, and a control board accommodated in the casing and connected to the printer module.

Among the above-mentioned portable printers, there is a portable printer to which a female-side connector for USB is provided. The female-side connector is mounted to the control board, and is exposed to an outside of the casing through a connector opening formed in the casing. A male-side connector (USB terminal) is mounted to the female-side connector at the time of, for example, communication between the portable printer and the host device, or charging of the portable printer.

Incidentally, the above-mentioned female-side connector may be supported by the control board under a state of being away from the casing (for example, inner peripheral surface of connector opening) in some cases. In this case, at the time of, for example, mounting or removing the male-side connector, an external force generated by twisting the male-side connector (hereinafter simply referred to as "twisting force") is liable to be transmitted to a mounting portion between the female-side connector and the control board.

Meanwhile, the female-side connector may also be fixed to the casing (inner peripheral surface of connector opening) so that the above-mentioned twisting force is prevented from being transmitted to the mounting portion. However, there is a disadvantage in that fixing the female-side connector to the casing causes the external force such as a drop impact, which is generated when the portable printer falls off, to be transmitted to the mounting portion through intermediation of the casing. Therefore, in the related-art portable printer, among the external forces transmitted to the mounting portion, it is difficult to reduce both the external forces of an external force directly acting on the female-side connector (for example, twisting force) and an external force acting through intermediation of the casing (for example, drop impact). Thus, there is a risk in that, for example, the female-side connector is separated from the control board. Accordingly, there still remains room for improvement of durability and reliability of the portable printer.

Further, when the female-side connector is fixed to the casing, there is a need to position the female-side connector and the casing at a high accuracy. However, when tolerance (for example, mounting tolerance of female-side connector to control board, dimensional tolerance of casing, control board, or other components, or coupling tolerance of the casing with the control board) is considered, there is a problem in that it is difficult to arrange the female-side connector at a desired position of the casing. In particular, in recent years, in order to achieve downsizing or lower cost, there is a case in which other electronic components such as LEDs and switching elements are collectively mounted on a single control board in addition to the female-side connector. In this case, when the control board is coupled to the casing with reference to the above-mentioned other electronic components, it is difficult to align the female-side connector and the connector opening, and there is a risk in that the female-side connector cannot be arranged at the desired position of the casing. Meanwhile, when the control board is coupled to the casing with reference to the female-side connector, there is a risk in that the other electronic components cannot be arranged at the desired position of the casing.

Further, when the female-side connector is away from the casing, and further a guide member configured to guide a mold part of the male-side connector and a cable of the male-side connector is arranged in the casing, it is conceivable that both the twisting force and the drop impact, which act on the mounting portion, can be reduced. However, the above-mentioned mold part and cable are not standardized, and hence it is difficult to form the guide member in conformity to various shapes. Moreover, there is a problem in that designability is lowered through provision of the guide member to the casing.

In view of the above-mentioned circumstances, in the portable printer of this type, it has been demanded that the durability and reliability be enhanced at the same time of achieving the simplification and the suppression of the lowering of the designability.

SUMMARY OF THE INVENTION

According to one embodiment of the present invention, there is provided a portable printer, including: a casing accommodating a printer module; a control board accommodated in the casing and electrically connected to the printer module; a female-side connector mounted on the control board and exposed to an outside of the casing through a connector opening formed in the casing, the female-side connector detachably mounting a male-side connector; and an elastic member interposed between an inner peripheral surface of the connector opening and an outer peripheral surface of the female-side connector.

In the above-mentioned portable printer according to the one embodiment of the present invention, the elastic member is interposed between the inner peripheral surface of the connector opening and the outer peripheral surface of the female-side connector along an entire circumference of the female-side connector.

In the above-mentioned portable printer according to the one embodiment of the present invention, when a part of the elastic member being positioned in the connector opening is viewed in an opening direction of the connector opening, an outer dimension of the elastic member is larger than an inner dimension of the connector opening when the connector opening is viewed in the opening direction, and the elastic member is arranged in the connector opening under a state of being elastically deformed.

In the above-mentioned portable printer according to the one embodiment of the present invention, the elastic member includes a buffer portion arranged between the inner peripheral surface of the connector opening and the outer peripheral surface of the female-side connector, and a regulation portion engaged with the female-side connector for regulating a movement of the elastic member to the outside of the casing through the connector opening with respect to the female-side connector.

In the above-mentioned portable printer according to the one embodiment of the present invention, a part of the control board, to which the female-side connector is mounted, constitutes a connector mounting portion configured to elastically support the female-side connector.

In the above-mentioned portable printer according to the one embodiment of the present invention, the control board includes a pair of slits formed therein, and a part of the control board, which is positioned between the pair of slits, constitutes the connector mounting portion.

In the above-mentioned portable printer according to the one embodiment of the present invention, the control board includes an electronic component which cooperates with a functional portion exposed to an outer surface of the casing.

DESCRIPTION OF THE EMBODIMENTS

Figure 1:
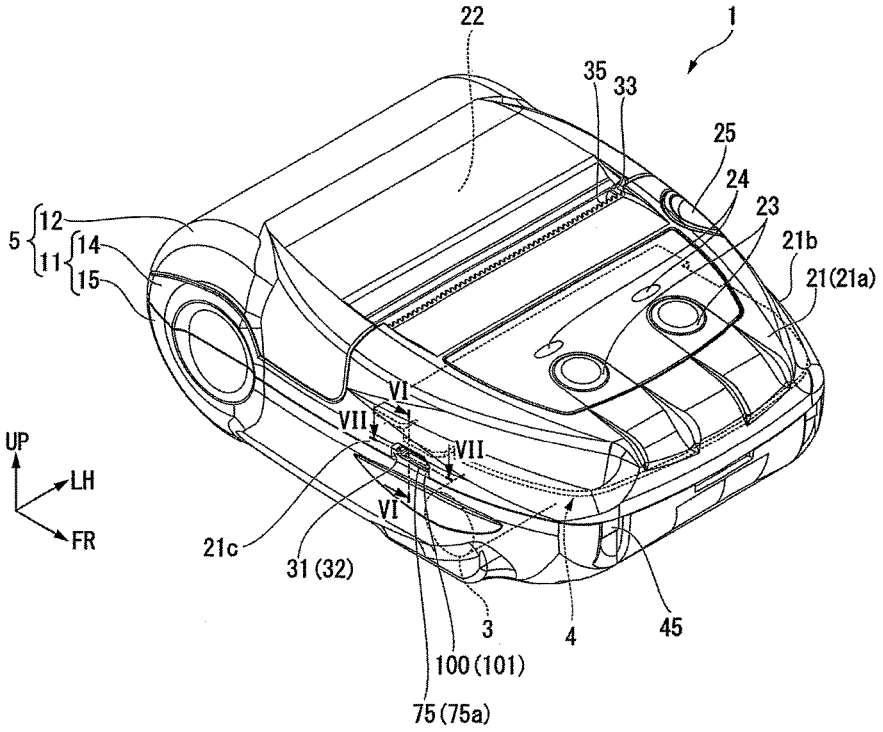
FIG. 1 is a perspective view of a portable printer according to an embodiment of the present invention, for illustrating a state in which a paper cover takes a closed position.
Figure 2:
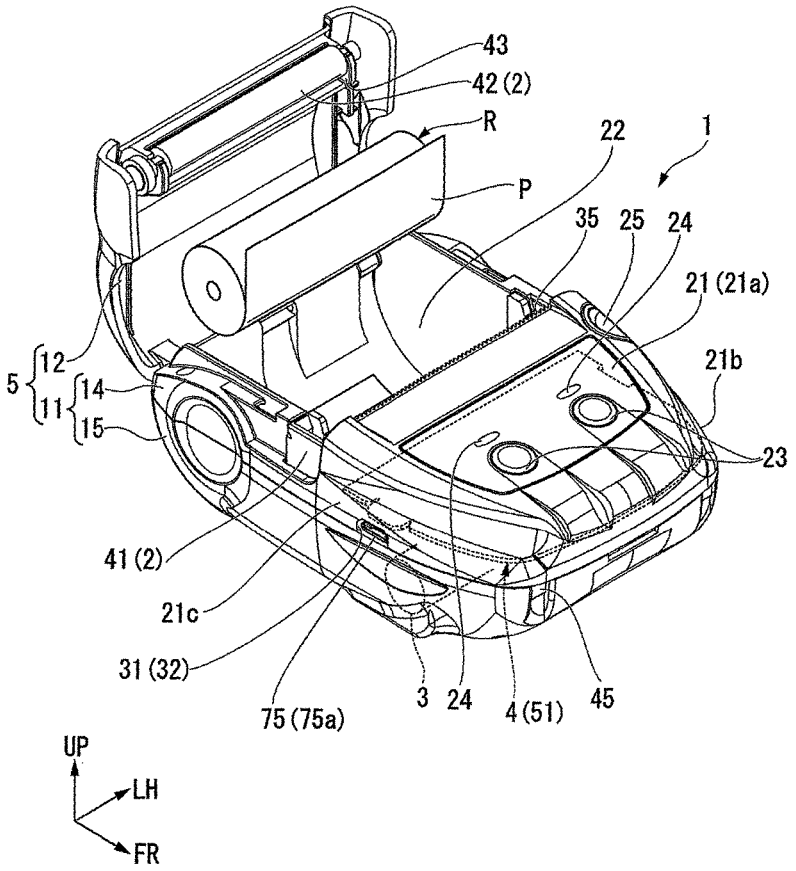
FIG. 2 is a perspective view of the portable printer according to the embodiment, for illustrating a state in which the paper cover takes an opened position.

FIG. 1 is a perspective view of a portable printer 1, for illustrating a state in which a paper cover 12 takes a closed position. FIG. 2 is a perspective view of the portable printer 1, for illustrating a state in which the paper cover 12 takes an opened position. In the following description, for the sake of convenience, the arrow FR in the drawings represents a forward direction, the arrow LH represents a leftward direction, and the arrow UP represents an upward direction. As illustrated in FIG. 1 and FIG. 2, the portable printer 1 of this embodiment is configured so as to be portable by a user. The portable printer 1 is configured to output (print) information, which is input to a host device (not shown), on a recording paper P (heat-sensitive paper) by communicating with the host device.

The portable printer 1 has a structure in which a printer module 2 (see FIG. 2), a battery 3, a control unit 4, or other components are accommodated in a casing 5.

The casing 5 includes a casing main body 11 and the paper cover 12. The casing main body 11 and the paper cover 12 are made of a resin material (for example, polycarbonate). The casing main body 11 is formed of an upper case 14 and a lower case 15 that are coupled in a vertical direction. The casing main body 11 has a component accommodating portion 21 positioned in a front portion of the casing main body 11, and a roll sheet receiving portion 22 positioned in a rear portion of the casing main body 11.

The component accommodating portion 21 is formed into a box shape opening rearward. Functional portions 23 to 25, which are configured to perform various operations of the portable printer 1, are arranged on an upper wall 21*a* of the component accommodating portion 21 (casing main body 11). The functional portions 23 to 25 include various function switches 23 (for example, power switch and Feed switch), display windows 24 configured to display states of the portable printer 1 (for example, power ON/OFF state and presence/absence of error), and an open button 25. In the illustrated example, two function switches 23 are arranged side by side in a lateral direction. Further, on the upper wall 21*a* of the component accommodating portion 21, two display windows 24 are arranged side by side in the lateral direction at portions positioned rearward with respect to the function switches 23. The open button 25 is arranged at a left side portion of the component accommodating portion 21 (corner portion formed between upper wall 21*a* and left side wall 21*b*) so as to be pressable.

A connector opening 31, which passes through a right side wall 21*c* in the lateral direction, is formed in the right side wall 21*c* of the component accommodating portion 21. The connector opening 31 is formed into a rectangular shape when viewed from the side in the lateral direction. The connector opening 31 is defined by a mating surface between the upper case 14 and the lower case 15. Specifically, the connector opening 31 is defined by an inner peripheral surface of a cutout portion 32 formed in the upper case 14 and an upper end surface of the lower case 15. The connector opening 31 may be formed only in the upper case 14, or may be formed only in the lower case 15.

As illustrated in FIG. 2, the roll sheet receiving portion 22 is formed into a box shape opening upward. The roll sheet receiving portion 22 is continuous with a rear end portion of the component accommodating portion 21. A roll sheet R is put into the roll sheet receiving portion 22 from above. The roll sheet R of this embodiment is formed by rolling up the recording paper P.

The paper cover 12 is rotatably coupled to a rear end portion of the roll sheet receiving portion 22 (casing main body 11). The paper cover 12 is configured to open or close the roll sheet receiving portion 22 along with rotary operations. At a closed position of the paper cover 12 illustrated in FIG. 1, a gap, which is formed between a front end edge of the paper cover 12 and a rear end edge of the upper wall 21*a* of the component accommodating portion 21, serves as a discharge port 33 configured to discharge the recording paper P. At the rear end edge of the upper wall 21*a*, there is arranged a cutting blade 35 configured to cut the recording paper P discharged through the discharge port 33.

As the printer module 2, a thermal printer is used, for example. The printer module 2 includes a head unit 41 having a thermal head, and a platen roller 42. The printer module 2 is configured to perform printing on the recording paper P by heating the recording paper P through use of the thermal head (not shown) under a state in which the recording paper P is nipped between the platen roller 42 and the thermal head. In this manner, a printed surface of the recording paper P is colored.

The head unit 41 is accommodated in a rear portion of the component accommodating portion 21. Specifically, the head unit 41 is assembled to the component accommodating portion 21 so that the thermal head faces an inside of the roll sheet receiving portion 22 from the front.

The platen roller 42 is arranged at a front end portion of a lower surface of the paper cover 12. As illustrated in FIG. 2, a platen support portion 43 is formed at the front end portion of the lower surface of the paper cover 12. The platen roller 42 is supported by the platen support portion 43 in a rotatable manner about an axis extending in the lateral direction. Further, the platen roller 42 is configured so as to be removably mountable to the head unit 41 along with opening and closing operations of the paper cover 12. That is, the platen roller 42 is coupled to the head unit 41 at the closed position of the paper cover 12. Meanwhile, through the pressing operation of the above-mentioned open button 25, an engagement between the head unit 41 and the platen roller 42 is released so that the paper cover 12 takes an opened position.

The battery 3 is accommodated in a lower portion of the component accommodating portion 21. The battery 3 is configured to supply electric power to the printer module 2 or other components through the control unit 4. Further, the battery 3 is charged by an external power supply (not shown) through a female-side connector 75, or a charging terminal 45 arranged at a front end portion of the component accommodating portion 21, which are described later. The charging terminal 45 is partially exposed to an outside from the front end portion of the component accommodating portion 21, and is connectable to an external terminal (not shown) of a cradle.

Figure 3:
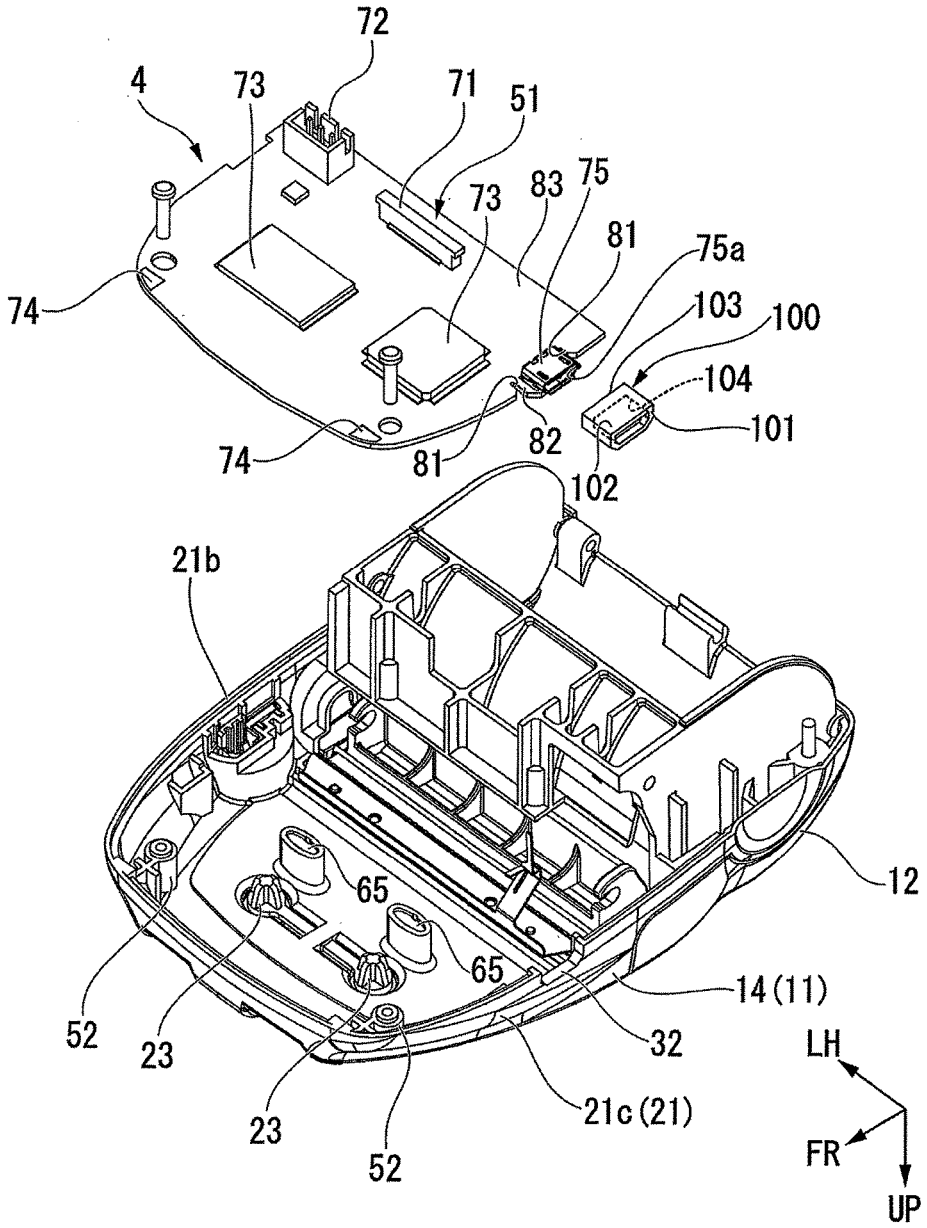
FIG. 3 is an exploded perspective view for illustrating a control unit and an upper case of the portable printer according to the embodiment.

FIG. 3 is an exploded perspective view for illustrating the control unit 4 and the upper case 14. As illustrated in FIG. 1 and FIG. 3, the control unit 4 is accommodated above the above-mentioned battery 3 in a front portion of the component accommodating portion 21. The control unit 4 has various electronic components mounted on a control board 51, which has wiring patterns (not shown) formed thereon.

As illustrated in FIG. 3, the control board 51 is arranged in the component accommodating portion 21 under a state in which the vertical direction matches with a thickness direction of the control board 51. Specifically, the control board 51 is fixed to board support portions 52 formed in the upper case 14 with screws and the like. In the illustrated example, the control board 51 is fixed to the upper case 14 so that a lower surface of the control board 51 is positioned above a lower surface of the upper case 14. The control board 51 may be fixed to the lower case 15.

Figure 4:
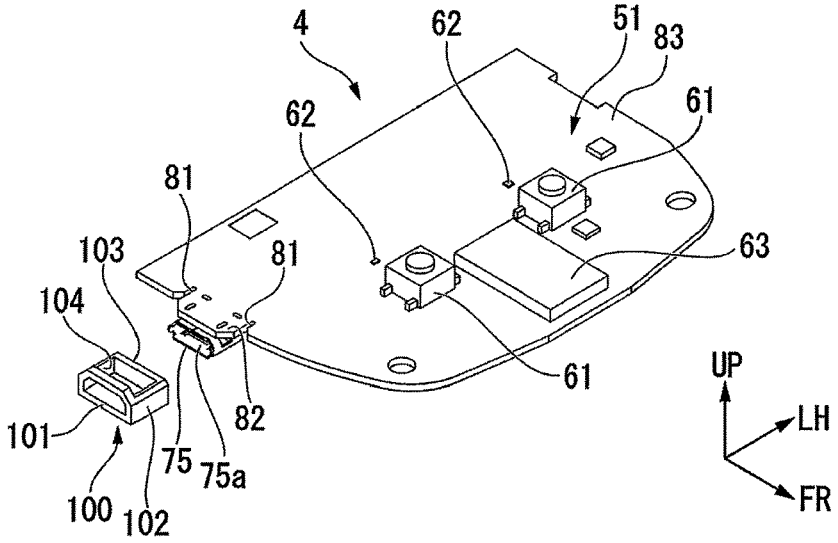
FIG. 4 is a perspective view for illustrating the control unit of the portable printer according to the embodiment, when viewed from above.

FIG. 4 is a perspective view for illustrating the control unit 4 when viewed from above. As illustrated in FIG. 4, on an upper surface of the control board 51, switching elements 61, LEDs 62, and a Bluetooth (registered trademark) module 63 are mounted, for example. The switching elements 61 are respectively arranged at positions of the control board 51, which overlap with the above-mentioned function switches 23 (see FIG. 1) when viewed from the vertical direction. That is, the switching elements 61 are operable in response to pressing operation of each of the function switches 23.

The LEDs 62 are respectively arranged at positions of the control board 51, which overlap with the above-mentioned display windows 24 (see FIG. 1) when viewed from the vertical direction. Light beams emitted from the LEDs 62 are propagated in light-guiding members 65 (see FIG. 3) which are arranged between the respective LEDs 62 and the upper wall 21*a* of the component accommodating portion 21. Then, the light beams exit to an outside of the casing 5 through the display windows 24. The Bluetooth (registered trademark) module 63 is configured to perform wireless communication between the portable printer 1 and the host device.

As illustrated in FIG. 3, on the lower surface of the control board 51, a printer adapter 71, a battery adapter 72, a driver IC 73, charging electrodes 74, the female-side connector 75, and other components are mounted. The printer adapter 71 is mounted to a rear end portion of the control board 51. A printer wire (not shown) which is drawn out from the printer module 2 (thermal head) is connected to the printer adapter 71. The battery adapter 72 is mounted to the rear end portion of the control board 51 on the left with respect to the printer adapter 71. A battery wire (not shown) which is drawn out from the battery 3 (see FIG. 1) is connected to the battery adapter 72. The charging electrodes 74 are formed at a front end portion of the control board 51. The charging electrodes 74 are connected to the above-mentioned charging terminal 45 (see FIG. 1) in the component accommodating portion 21, and to the battery adapter 72 and other components through the wiring patterns (not shown). It is possible to appropriately change a type, a layout, and other factors of the electronic components mounted to the control board 51.

Figure 5:
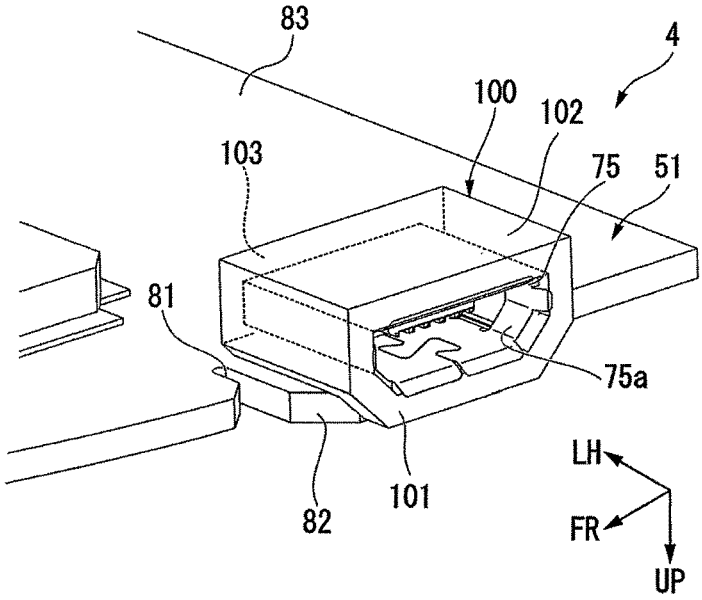
FIG. 5 is a perspective view for illustrating a periphery of a female-side connector of the control unit of the portable printer according to the embodiment.
Figure 6:
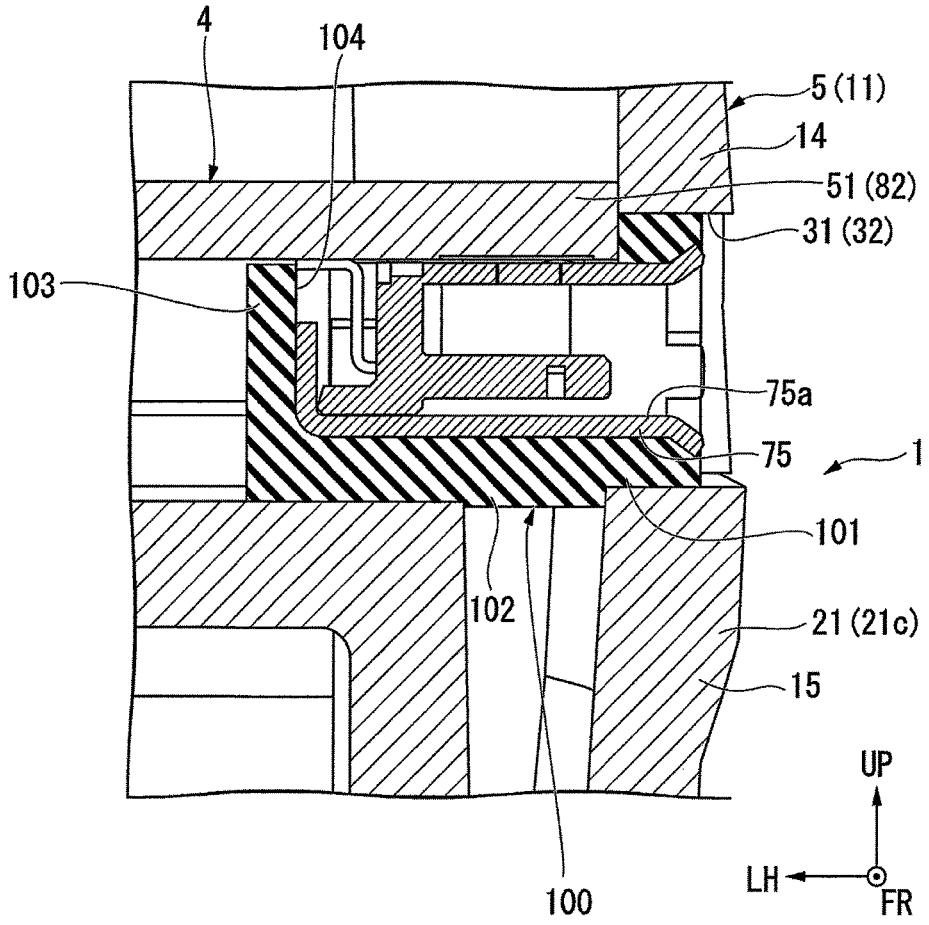
FIG. 6 is a sectional view taken along the line VI-VI of FIG. 1.
Figure 7:
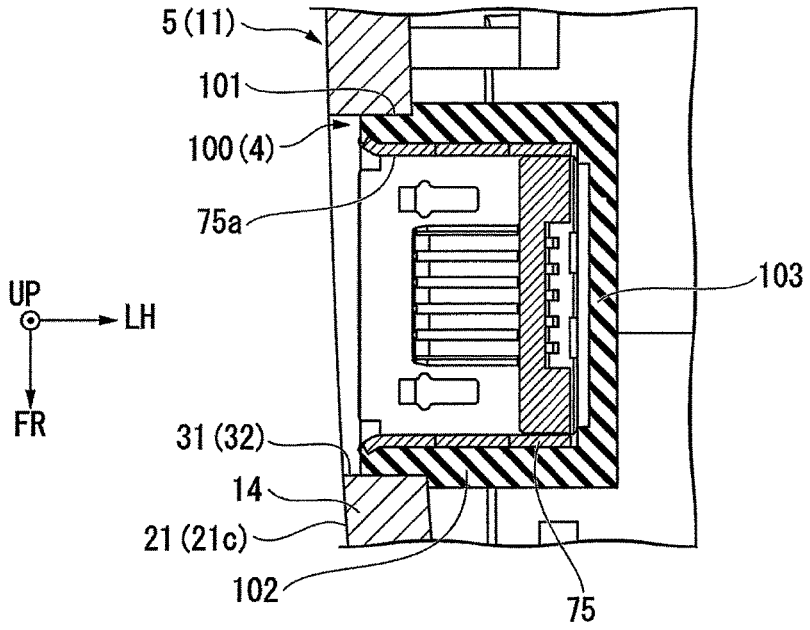
FIG. 7 is a sectional view taken along the line VII-VII of FIG. 1.

FIG. 5 is a perspective view for illustrating a periphery of the female-side connector 75 of the control unit 4. FIG. 6 is a sectional view taken along the line VI-VI of FIG. 1. FIG. 7 is a sectional view taken along the line VII-VII of FIG. 1. As illustrated in FIG. 5 to FIG. 7, the female-side connector 75 is mounted to a right-side end portion of the lower surface of the control board 51. A USB (micro-B) connector is used as the female-side connector 75, for example. The female-side connector 75 is mounted to the control board 51 under a state in which an opening 75*a* is oriented rightward. A right-side end portion of the female-side connector 75 protrudes rightward with respect to the control board 51. The right-side end portion of the female-side connector 75 enters the above-mentioned connector opening 31 from the left.

Figure 8:
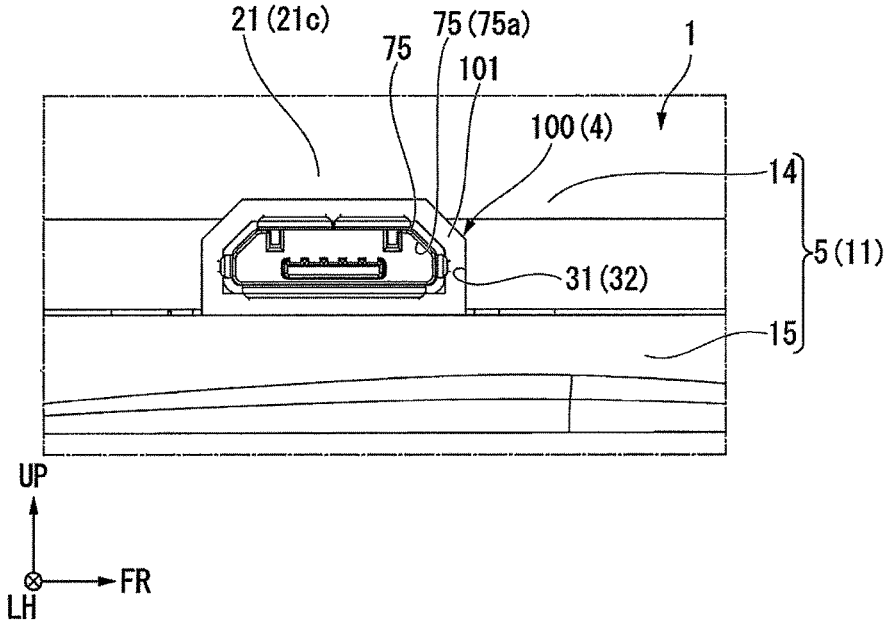
FIG. 8 is an enlarged side view of the portable printer according to the embodiment when viewed from the right side.

FIG. 8 is an enlarged side view of the portable printer 1 when viewed from the right side. As illustrated in FIG. 6 to FIG. 8, the female-side connector 75 is exposed to the outside of the casing 5 through the above-mentioned connector opening 31. The female-side connector 75 is configured so that the male-side connector (not shown) is removably mountable through the connector opening 31. In this embodiment, the female-side connector 75 is used for, for example, wired communication between the portable printer 1 and the host device, or charging from the external power supply.

As illustrated in FIG. 3 and FIG. 4, slits 81 are respectively formed at portions which are positioned on both front and rear sides of the control board 51 with respect to the portion to which the female-side connector 75 is mounted. Each of the slits 81 passes through the control board 51 in the vertical direction, and extends in the lateral direction. Each of the slits 81 is opened in a right-side end surface of the control board 51.

Further, the control board 51 of this embodiment is divided into a connector mounting portion 82 to which, among the above-mentioned electronic components, the female-side connector 75 is mounted, and a main body mounting portion 83 to which the electronic components other than the female-side connector 75 (for example, switching elements 61, LEDs 62, and charging electrodes 74) are mounted. In this case, the connector mounting portion 82 can be bendingly deformable while protruding rightward from the main body mounting portion 83 in a cantilever manner. Therefore, the female-side connector 75 is elastically supported by the control board 51 through intermediation of the connector mounting portion 82. In the illustrated example, a right-side end surface of the connector mounting portion 82 slightly protrudes rightward with respect to a right-side end surface of the main body mounting portion 83. The right-side end surface of the connector mounting portion 82 may be flush with the right-side end surface of the main body mounting portion 83, or may be arranged leftward with respect to the right-side end surface of the main body mounting portion 83.

As illustrated in FIG. 4 and FIG. 5, a connector cover 100 is mounted to the female-side connector 75. The connector cover 100 is an elastic member made of an elastically deformable material (for example, polyurethane or rubber). The connector cover 100 is formed into a box shape opening upward and rightward.

Specifically, the above-mentioned connector cover 100 includes a buffer portion 101 fitted onto the right-side end portion of the female-side connector 75. The buffer portion 101 is formed into a rectangular frame shape. That is, the buffer portion 101 circumferentially surrounds a periphery of the right-side end portion of the female-side connector 75. When viewed from the side in the lateral direction, an inner dimension of the buffer portion 101 is smaller than an outer dimension of the female-side connector 75. Specifically, it is preferred that the buffer portion 101 secure an interference between the buffer portion 101 and the female-side connector 75. With this structure, the buffer portion 101 is fitted onto the female-side connector 75 under a state of being elastically deformed.

As illustrated in FIG. 6 to FIG. 8, in the above-mentioned connector opening 31, the buffer portion 101 is interposed between an outer peripheral surface of the female-side connector 75 and an inner peripheral surface of the connector opening 31 (upper end surface of lower case 15 and inner peripheral surface of cutout portion 32). In this embodiment, the buffer portion 101 is fitted into the connector opening 31. With this structure, the female-side connector 75 and the buffer portion 101 are exposed to the outside of the casing 5 through the connector opening 31. When viewed from the side in the lateral direction, an outer dimension of the buffer portion 101 is larger than an inner dimension of the connector opening 31. That is, it is preferred that the buffer portion 101 secure an interference between the buffer portion 101 and the connector opening 31. With this structure, the buffer portion 101 is fitted into the connector opening 31 under the state of being elastically deformed.

The above-mentioned buffer portion 101 is arranged between the outer peripheral surface of the female-side connector 75 and the inner peripheral surface of the connector opening 31 along an entire circumference of the female-side connector 75 without any gap. Further, it is preferred that a right-side end surface of the buffer portion 101 be arranged at the same position as a right end edge of the female-side connector 75, or on the left with respect to the female-side connector 75. With this structure, when the connectors are mounted, an interference between the buffer portion 101 and the male-side connector can be prevented.

As illustrated in FIG. 4 and FIG. 5, the connector cover 100 includes a connection portion 102 extending leftward from the buffer portion 101. The connection portion 102 is formed integrally with the buffer portion 101. The connection portion 102 surrounds a lower surface and both front and rear surfaces of the female-side connector 75.

As illustrated in FIG. 6 and FIG. 7, the connector cover 100 includes a regulation portion 103 continuous with a left-side end portion of the connection portion 102. The regulation portion 103 is formed integrally with the connection portion 102 and the buffer portion 101. The regulation portion 103 covers a left-side end surface of the female-side connector 75 from the left. That is, the regulation portion 103 is engaged with (held in abutment against) the left-side end surface of the female-side connector 75 from the left. Specifically, the regulation portion 103 regulates a movement of the connector cover 100 to the right with respect to the female-side connector 75 (movement to outside of casing 5 through connector opening 31). However, the regulation portion 103 may be away from the left-side end surface of the female-side connector 75. Further, in the illustrated example, upper end surfaces of the connection portion 102 and the regulation portion 103 are close to or held in abutment against the control board 51 (connector mounting portion 82) from the lower side.

As illustrated in FIG. 4 and FIG. 6, in the connector cover 100, a part defined by an upper portion of the buffer portion 101, and upper end portions of the connection portion 102 and the regulation portion 103 form a mounting opening 104 opening upward. In this embodiment, in order to mount the connector cover 100 to the female-side connector 75, for example, the female-side connector 75 is caused to enter the connector cover 100 from the lower side through the mounting opening 104, while fitting the female-side connector 75 into the buffer portion 101 from the left. In this manner, as described above, the connector cover 100 is mounted to the female-side connector 75.

As described above, in this embodiment, the connector cover 100 (buffer portion 101) is interposed between the inner peripheral surface of the connector opening 31 and the outer peripheral surface of the female-side connector 75. According to this structure, the female-side connector 75 can be prevented from shifting along with, for example, twisting of the male-side connector. Thus, a twisting force generated when mounting or removing the male-side connector can be reduced, thereby being capable of reducing a twisting force transmitted to a mounting portion between the female-side connector 75 and the control board 51. Further, the connector cover 100 is interposed between the inner peripheral surface of the connector opening 31 and the outer peripheral surface of the female-side connector 75, thereby being capable of alleviating a drop impact input to the casing 5 by the connector cover 100. In this manner, the drop impact can be prevented from being transmitted to the mounting portion. Accordingly, in the portable printer 1 of this embodiment, there can be reduced, among external forces transmitted to the mounting portion, both external forces of an external force directly acting on the female-side connector 75 (for example, twisting force) and an external force acting through intermediation of the casing 5 (for example, drop impact). As a result, for example, separation of the female-side connector 75 from the control board 51 is prevented, thereby being capable of enhancing durability and reliability of the portable printer 1.

Moreover, the connector cover 100 is made of the elastically deformable material so that the shift amount can be absorbed by the elastic deformation of the connector cover 100, even when the position of the female-side connector 75 with respect to the connector opening 31 is shifted from a desired position due to tolerance. Accordingly, the control board 51 can be arranged in the casing 5 without considering a positional accuracy of the female-side connector 75. Therefore, the other electronic components mounted to the control board 51 can be arranged in the casing 5 at a higher accuracy as compared to a case in which the control board 51 is mounted to the casing 5 with reference to the female-side connector 75. In this case, in order to secure the positional accuracy of the female-side connector 75 with respect to the connector opening 31, there is no need to separate a board to which the female-side connector 75 is mounted and a board to which the other electronic components are mounted. That is, the female-side connector 75 and the other electronic components can be mounted to a single control board 51, thereby being capable of achieving downsizing and cost reduction of the control board 51. Therefore, the downsized and low-cost portable printer 1 can be provided.

Further, in order to reduce both the twisting force and the drop impact, which act on the mounting portion, there is no need to arrange a guide member for the male-side connector in the casing 5, thereby being capable of suppressing lowering of the designability and complication of the structure. As described above, in the portable printer 1 of this embodiment, it is possible to suppress the lowering of the designability, achieve simplification, and enhance the durability and reliability.

In this embodiment, it is possible to reliably suppress both the twisting force and drop impact, which act on the mounting portion, because the connector cover 100 (buffer portion 101) is interposed between the inner peripheral surface of the connector opening 31 and the outer peripheral surface of the female-side connector 75 along the entire circumference of the female-side connector 75.

In this embodiment, the connector cover 100 is arranged in the connector opening 31 under the state of being elastically deformed. Therefore, the connector cover 100 can be arranged between the inner peripheral surface of the connector opening 31 and the outer peripheral surface of the female-side connector 75 without any gap. With this structure, both the twisting force and the drop impact, which act on the mounting portion, can reliably be reduced. Further, it is possible to prevent dust and liquid from entering the casing 5 through a gap between the inner peripheral surface of the connector opening 31 and the outer peripheral surface of the female-side connector 75. At the same time, it is possible to prevent static electricity or noise from transmitting to the control board 51 through the above-mentioned gap. As a result, the reliability of the portable printer 1 can be enhanced more.

The connector cover 100 of this embodiment includes the regulation portion 103 for regulating the movement of the connector cover 100 to the outside of the casing 5 through the connector opening 31. Thus, the connector cover 100 can be prevented from falling off from the female-side connector 75.

In this embodiment, the control board 51 includes the connector mounting portion 82 for elastically supporting the female-side connector 75. Thus, when the twisting force and the drop impact are input to the female-side connector 75, the connector mounting portion 82 is bendingly deformed. With this structure, the twisting force and the drop impact, which act in a thickness direction of the mounting portion (vertical direction), can more effectively be reduced.

In this embodiment, the part of the control board 51 positioned between a pair of the slits 81 forms the connector mounting portion 82. Thus, as compared to a case in which the connector mounting portion 82 protrudes with respect to an outer peripheral edge of the main body mounting portion 83, the control board 51 can be downsized. In this case, in the casing main body 11 (component accommodating portion 21), it is possible to prevent a dead space from being formed at a part which is positioned on both front and rear sides of the connector mounting portion 82. As a result, the portable printer 1 can further be downsized.

In this embodiment, cooperative electronic components (switching elements 61, LEDs 62, and charging electrodes 74), which are cooperative with the functional portions (for example, function switches 23, display windows 24, and charging terminal 45) exposed to an outer surface of the casing 5, are mounted to a single control board 51 together with the female-side connector 75. According to this structure, as described above, it is possible to arrange the other electronic components, which are mounted to a single control board 51 together with the female-side connector 75, in the casing 5 at a high accuracy without considering the positional tolerance of the female-side connector 75 in this embodiment. Therefore, positional shift between the cooperative electronic components and the functional portions can be suppressed. As a result, excellent operability (for example, pressing operability or visibility) can be provided to the functional portions.

The technical scope of the present invention is not limited to the above-mentioned embodiment, but various modifications may be made without departing from the gist of the present invention.

In the above-mentioned embodiment, description is made of the structure in which the thermal printer is used as the printer module 2. However, the present invention is not limited to the structure, and various printer modules (for example, dot impact type) can be used. In the above-mentioned embodiment, description is made of the structure in which the USB connector is used as the female-side connector 75. However, the present invention is not limited to the structure, and the female-side connector having various standards (for example, serial connector) can be used. Further, an outer shape of the female-side connector 75 is not limited to a rectangular shape.

In the above-mentioned embodiment, description is made of the structure in which the connector cover 100 covers all part of the female-side connector 75 except for the opening 75*a* and the mounting surface with the control board 51. However, the present invention is not limited to the structure. For example, the connector cover only needs to be interposed at least between the inner peripheral surface of the connector opening 31 and the outer peripheral surface of the female-side connector 75 (part corresponding to buffer portion 101). Further, in the above-mentioned embodiment, description is made of the structure in which the regulation portion 103 is engaged with the left-side end surface of the female-side connector 75. However, the present invention is not limited to the structure. The regulation portion may be formed at any positions and into any shapes as long as the regulation portion regulates the movement of the connector cover to the outside of the casing 5 through the connector opening 31.

In the above-mentioned embodiment, description is made of the structure in which the part of the control board 51, which is positioned between the slits 81, forms the connector mounting portion 82. However, the present invention is not limited to the structure, and the connector mounting portion 82 may protrude with respect to the right-side end surface of the main body mounting portion 83.

Besides the above, the components in the above-mentioned embodiment may be replaced by well-known components as appropriate without departing from the gist of the present invention. The above-mentioned modification examples may be combined with each other as appropriate.

What is claimed is:

1. A portable printer, comprising:

a casing accommodating a printer module;

a control board accommodated in the casing and electrically connected to the printer module;

a female-side connector mounted on the control board and exposed to an outside of the casing through a connector opening formed in the casing, the female-side connector being configured to detachably mount a male-side connector; and a connector cover made of an elastically deformable material and mounted to the female-side connector, the connector cover being interposed between an inner peripheral surface of the connector opening and an outer peripheral surface of the female-side connector along an entire circumference of the female-side connector, the connector cover including a buffer portion fitted onto an end portion of the female-side connector, a connection portion extending from the buffer portion, and a regulation portion continuous with an end portion of the connection portion;

wherein a part defined by the regulation portion and portions of the buffer portion and connection portion form a mounting opening of the connector cover through which the female-side connector is caused to enter to mount the connector cover to the female-side connector.

2. A portable printer according to claim 1, wherein an outer dimension of the connector cover, when a part of the connector cover being positioned in the connector opening is viewed in an opening direction of the connector opening, is larger than an inner dimension of the connector opening when the connector opening is viewed in the opening direction, and wherein the connector cover is arranged in the connector opening under a state of being elastically deformed.

3. A portable printer according to claim 2, wherein the buffer portion is arranged between the inner peripheral surface of the connector opening and the outer peripheral surface of the female-side connector; and wherein the regulation portion is engaged with the female-side connector, the regulation portion regulating a movement of the connector cover to the outside of the casing through the connector opening with respect to the female-side connector.

4. A portable printer according to claim 3, wherein a part of the control board, to which the female-side connector is mounted, constitutes a connector mounting portion configured to elastically support the female-side connector.

5. A portable printer according to claim 4, wherein the control board includes a pair of slits formed therein, and wherein a part of the control board, which is positioned between the pair of slits, constitutes the connector mounting portion.

6. A portable printer according to claim 5, wherein the control board includes an electronic component, which is cooperative with a functional portion exposed to an outer surface of the casing.

7. A portable printer according to claim 1, wherein the buffer portion is arranged between the inner peripheral surface of the connector opening and the outer peripheral surface of the female-side connector; and wherein the regulation portion is engaged with the female-side connector, the regulation portion regulating a movement of the connector cover to the outside of the casing through the connector opening with respect to the female-side connector.

8. A portable printer according to claim 1, wherein a part of the control board, to which the female-side connector is mounted, constitutes a connector mounting portion configured to elastically support the female-side connector.

9. A portable printer according to claim 8, wherein the control board includes a pair of slits formed therein, and wherein a part of the control board, which is positioned between the pair of slits, constitutes the connector mounting portion.

10. A portable printer according to claim 1, wherein the control board includes an electronic component, which is cooperative with a functional portion exposed to an outer surface of the casing.

11. A portable printer according to claim 1, wherein the connector cover is interposed between the inner peripheral surface of the connector opening and the outer peripheral surface of the female-side connector along the entire circumference of the female-side connector without any gap.

12. A portable printer according to claim 1, wherein the buffer portion is arranged between the inner peripheral surface of the connector opening and the outer peripheral surface of the female-side connector, and the connection portion is formed integrally with and extending from the buffer portion, the connector portion surrounding a lower surface and both front and rear surfaces of the female-side connector.

13. A portable printer according to claim 12, wherein the regulation portion is engaged with the female-side connector, the regulation portion regulating a movement of the connector cover to the outside of the casing through the connector opening with respect to the female-side connector.

14. A portable printer comprising:

a casing accommodating a printer module;

a control board accommodated in the casing and electrically connected to the printer module;

a female-side connector mounted on the control board and exposed to an outside of the casing through a connector opening formed in the casing, the female-side connector being configured to detachably mount a male-side connector; and a connector cover made of an elastically deformable material and mounted to the female-side connector, the connector cover being interposed between an inner peripheral surface of the connector opening and an outer peripheral surface of the female-side connector along an entire circumference of the female-side connector, the connector cover including a buffer portion circumferentially surrounding a periphery of an end portion of the female-side connector, a connection portion extending from the buffer portion, and a regulation portion continuous with an end portion of the connection portion;

wherein a part defined by the regulation portion and portions of the buffer portion and connection portion form a mounting opening of the connector cover through which the female-side connector is caused to enter to mount the connector cover to the female-side connector.

15. A portable printer according to claim 14, wherein the buffer portion is fitted onto the end portion of the female-side connector under a state of being elastically deformed.

16. A portable printer according to claim 14, wherein the female-side connector and the buffer portion are exposed to the outside of the casing through the connector opening.

17. A portable printer according to claim 16, wherein the buffer portion is fitted into the connector opening under a state of being elastically deformed.

18. A portable printer according to claim 14, wherein the connector cover is interposed between the inner peripheral surface of the connector opening and the outer peripheral surface of the female-side connector along the entire circumference of the female-side connector without any gap.

* * * * *